US006032657A

United States Patent [19]

Rossi et al.

[11] Patent Number: 6,032,657

[45] Date of Patent: Mar. 7, 2000

[54] MULTI SPARK IGNITION SYSTEM

[75] Inventors: Daniele Rossi, Bologna; Giorgio Bernardi; Giovanni Casazza, both of Modena, all of Italy

[73] Assignee: Cooper Industries Italia Spa, Italy

[21] Appl. No.: 09/084,978

[22] Filed: May 28, 1998

[30] Foreign Application Priority Data

Jun. 2, 1997 [EP] European Pat. Off. ..... 97830265

[51] Int. Cl.[7] ..... F02P 3/05; F02P 15/08

[52] U.S. Cl. ..... 123/625; 123/637; 123/644

[58] Field of Search ..... 123/606, 630, 123/637, 644, 625

[56] References Cited

U.S. PATENT DOCUMENTS

| | | | |
|---|---|---|---|
| 3,926,557 | 12/1975 | Callies et al. | 123/637 X |
| 3,945,362 | 3/1976 | Neuman et al. | 123/637 X |
| 4,112,890 | 9/1978 | Manger et al. | 123/637 X |
| 4,653,459 | 3/1987 | Herden | 123/637 |
| 5,170,760 | 12/1992 | Yamada et al. | 123/295 |
| 5,174,267 | 12/1992 | DeBiasi | 123/643 |

FOREIGN PATENT DOCUMENTS

| | | |
|---|---|---|
| 0070572 | 1/1983 | European Pat. Off. . |
| 0652363 | 5/1995 | European Pat. Off. . |
| 4226248 | 2/1994 | Germany . |
| WO-92/19863 | 11/1992 | WIPO . |
| WO-94/16214 | 7/1994 | WIPO . |

*Primary Examiner*—Tony M. Argenbright
*Attorney, Agent, or Firm*—Fish & Richardson P.C.

[57] ABSTRACT

An ignition system for internal combustion engines with spark ignition comprising an ignition coil, a spark plug connected to the secondary winding, an electric supply circuit associated with the primary winding of the coil, where the said circuit includes a semiconductor device controlled by an electronic control unit programmed to produce a charging cycle in the course of which the instantaneous current flowing in the primary winding gradually increases from a minimum value to a maximum value and then returns brusquely to the minimum value. The electronic control unit is programmed to produce a succession of charging cycles during one and the same engine cycle. Each of the said charging cycles is separated from the previous cycle by a time interval (W) of a duration that is either equal to or greater than the duration (DA) of a discharge cycle.

22 Claims, 5 Drawing Sheets

MULTI SPARK IGNITION SYSTEM

Figure 2:
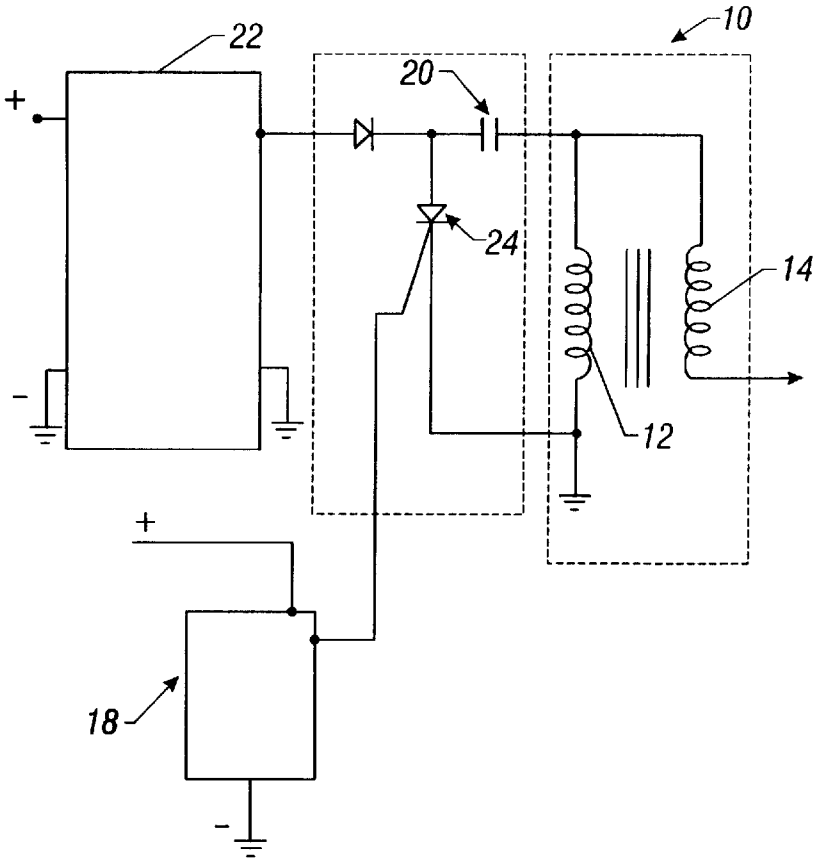

The present invention relates to an ignition system for internal combustion engines with spark ignition.

The ignition systems generally used in the automotive industry comprise an ignition coil connected to a spark plug that produces a spark when the voltage at the terminals of the secondary coil winding exceeds a pre-established threshold value that could be, for example, of the order of 20–35 kV. The primary winding forms part of a supply circuit that includes a semiconductor device piloted by an electronic control unit in such a manner as to produce cyclic variations of the instantaneous current flowing in the primary winding. As used hereinafter, the term "charging cycle" is intended to designate a cycle in the course of which the instantaneous current flowing in the primary winding (more briefly referred to as the "primary current") increases gradually from a minimum value to a maximum value and then returns brusquely to its minimum value. When the spark is triggered, the discharge cycle produced in the secondary winding is such that the secondary current passes brusquely from zero to the maximum value corresponding to the secondary peak voltage and then gradually returns to zero. The duration of the discharge cycle is substantially the same as the duration of the spark.

In the traditional ignition systems the duration of the spark represents a critical factor that is of fundamental importance for the purposes of correct and complete combustion of the air-fuel mixture. The duration of the spark is normally determined in such a manner as to ensure ignition of the air-fuel mixture even in the most unfavourable conditions, ignition in a cold engine at low environmental temperatures being a case in point. The duration of the charging cycles of the coil in the ignition systems normally used in the automotive industry is always greater than 2 ms and will normally lie in the range between 2 and 4 ms. Experimental tests have shown that the duration of the spark is always shorter than the duration of the charging cycle, which depends on the inductance of the coil.

From the technological point of view, therefore, it is essential to have ignition coils of high inductance if sparks of long duration are to be obtained and this, in turn, implies that one has to produce coils with a large number of turns and therefore also of relatively great mass and size. Recent years have seen engine design tend towards solutions in which each spark plug is provided with its own ignition coil arranged in a small recess of the cylinder head positioned directly above the spark plug. Consequently, on one hand there is need for realizing large coils in order to ensure a sufficiently high inductance and the spark duration that goes with it, on the other hand it would be desirable to have small and compact coils capable of being accommodated in the small spaces available immediately above the plug. Furthermore, prior art coils with relatively large inductances are associated with the additional drawback of having very high operating temperatures that represent a critical feature from the point of view of reliability.

It is therefore the object of the present invention to provide an ignition system that will overcome the drawbacks just described.

According to the present invention this object is attained by an ignition system having the characteristics set.

The present invention is essentially based on the principle of producing several charging cycles of very short duration during one and the same engine cycle, where the short duration may be, for example, less than 400 $\mu$s and preferably of the order of 50–250 $\mu$s or four-stroke automobile engines with maximum rotation speeds of the order of 5000–6000 r.p.m. In the system according to the invention, moreover, each of the charging cycles is separated from the previous cycle by a time shift that is equal to or greater than the duration of the discharge cycle (spark duration). Experimental tests have confirmed that the best results from the point of view of combustion quality are obtained with multiple charging cycles that follow each other in the most rapid succession possible without actually arriving at a superposition of a charging cycle and a spark.

The number of charging and discharge cycles in each engine cycle may be either fixed or be made to vary as a function of one or more operating parameters of the engine, among them, for example, the angle of aperture of the throttle valve that determines the quantity of air sucked in during each engine cycle.

The fact of arranging several charging cycles within a single engine cycle also makes it possible to obtain a check as to whether combustion has effectively taken place in the combustion chamber. It has in fact been noted that the rate of growth of the primary current depends on whether or not combustion has occurred in the chamber. Controlling the rate of growth of the primary current therefore makes it possible to generate an electric signal that will show whether or not combustion is effectively taking place. This information can then be used for diagnosing purposes, for example, for detecting the lack of ignition, spontaneous ignition, presence of knocking, etc., in either a part or the whole of the engine cycle.

Figure 1:
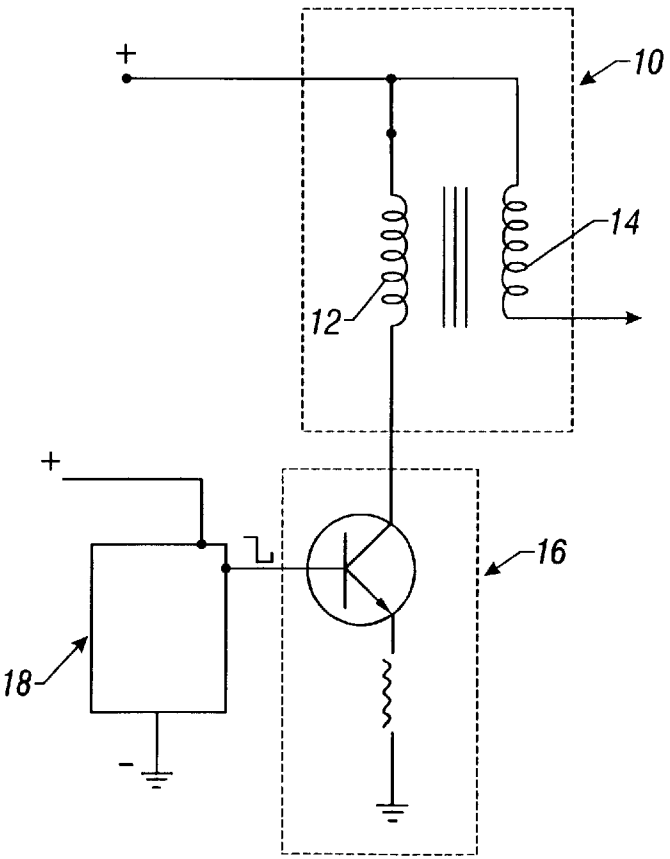
Figure 3:
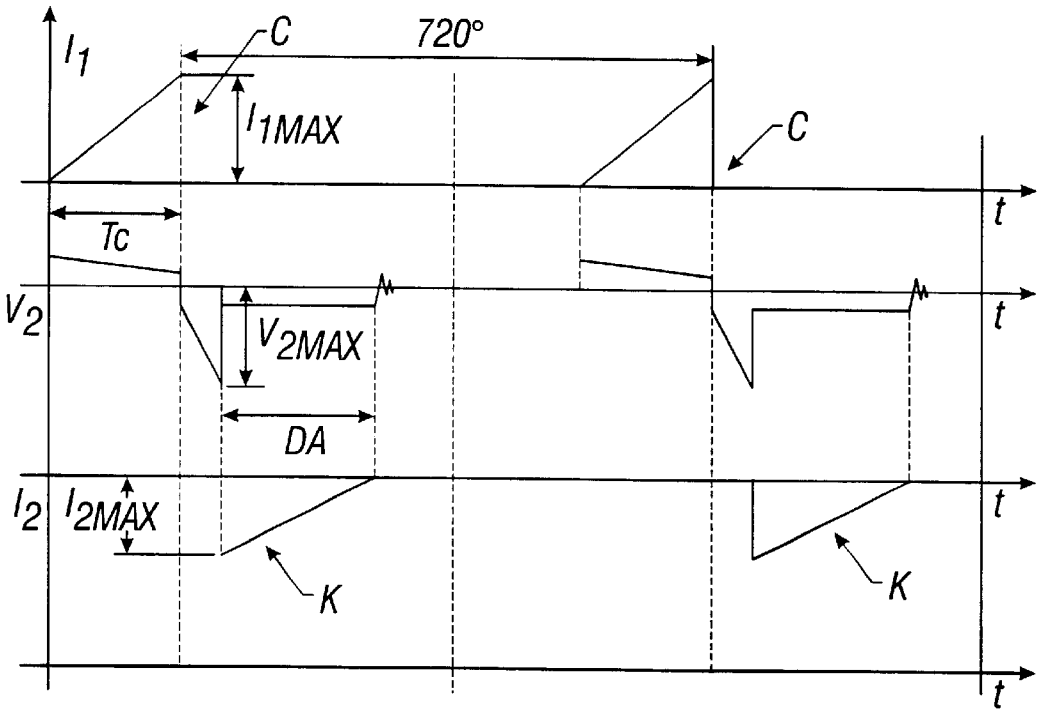
Figure 4:
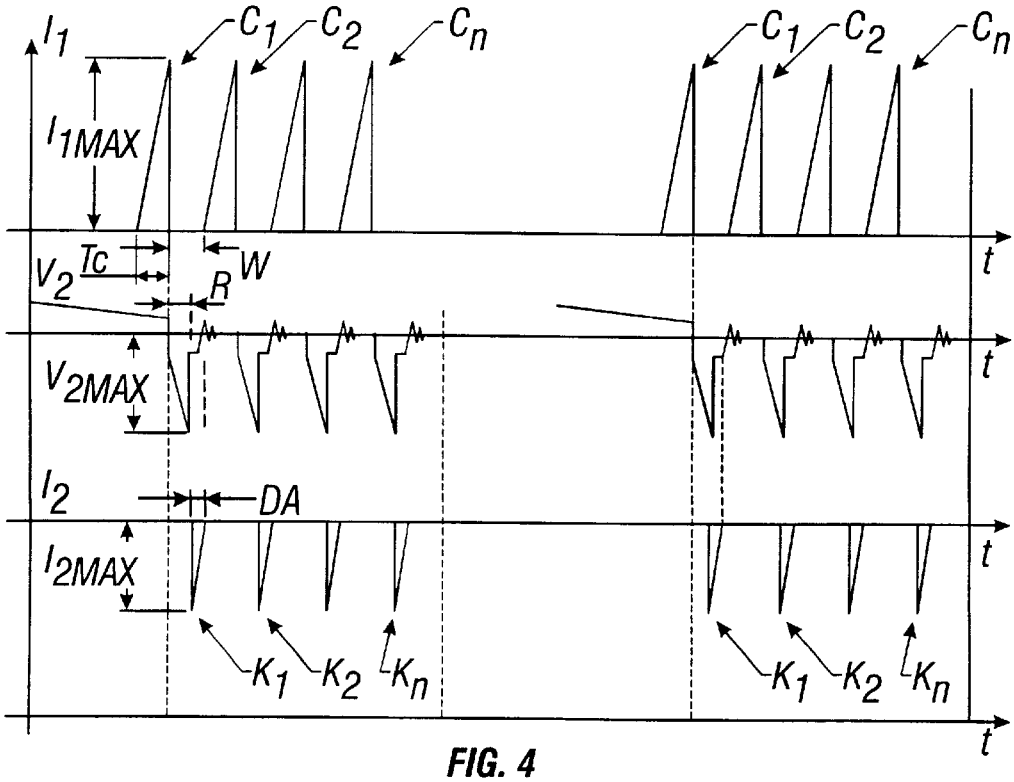
Figure 5:
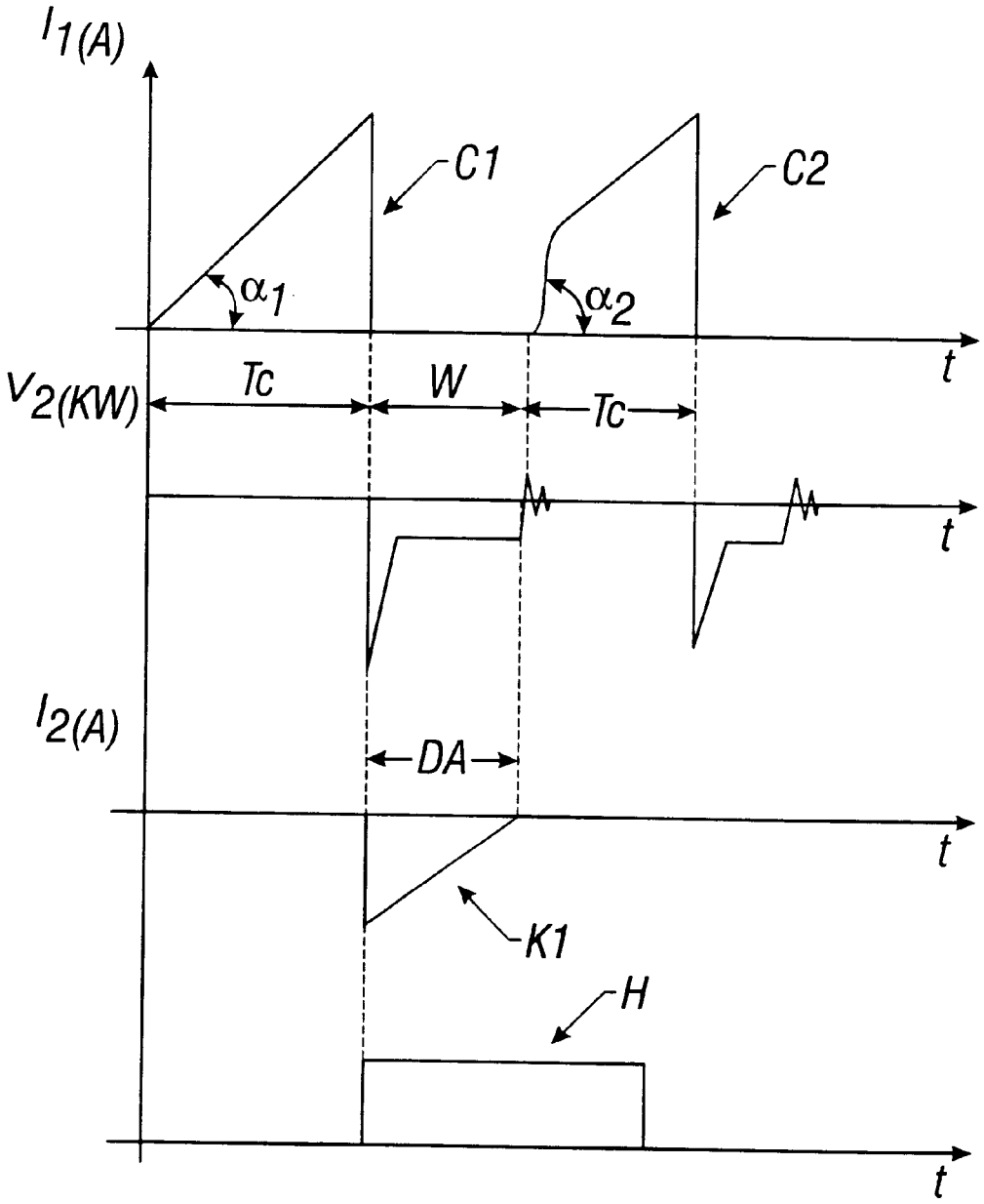
Figure 6:
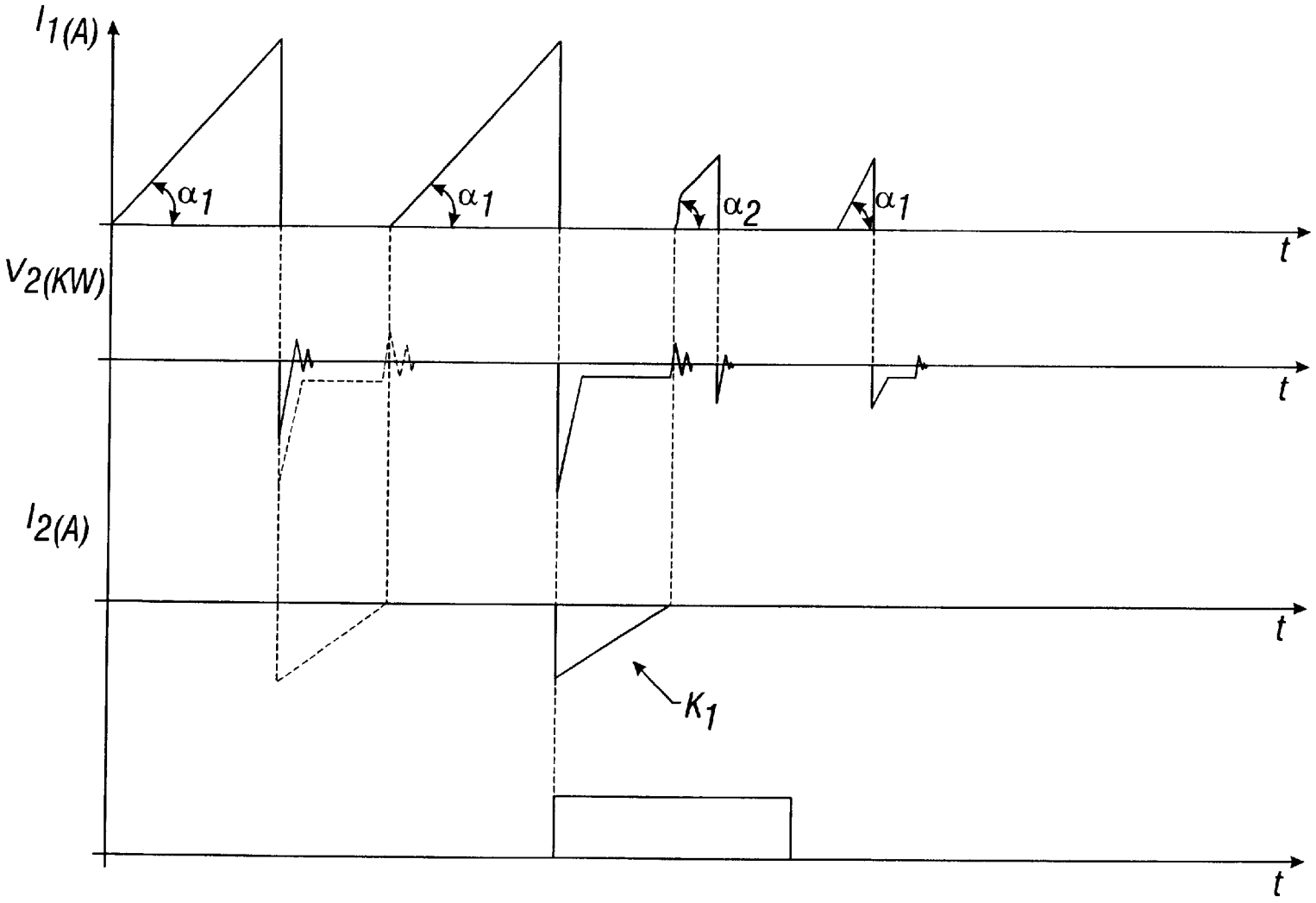
Figure 7:
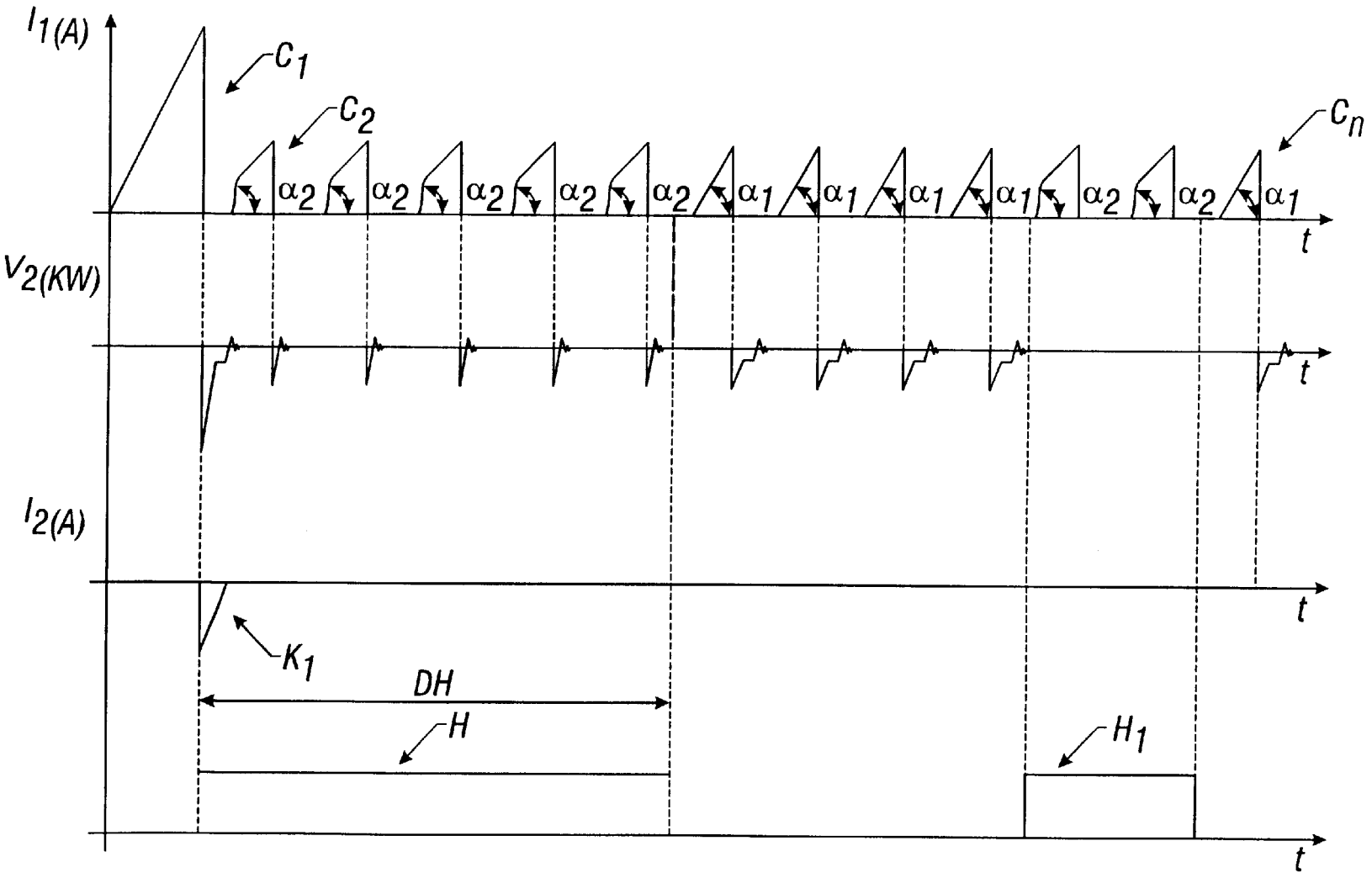

Further characteristics and advantages of the present invention will become evident in the course of the detailed description which follows, given solely by way of non-limitative example, with reference to the attached drawings, wherein:

FIGS. 1 and 2 show the electric circuit layouts of two traditional ignition systems with, respectively, inductive and capacitive discharge, FIG. 3 is a graph illustrating the time patterns of the primary current, the secondary voltage and the secondary current in the ignition coil of a traditional-type ignition system, FIG. 4 is a graph similar to the one of FIG. 3, but relating to an ignition system in accordance with the invention, and FIGS. 5, 6 and 7 are graphs similar to the one of FIG. 4 that illustrate different operating conditions of the system according to the invention.

FIG. 1 shows a classical arrangement of an ignition system of the inductive discharge type for internal combustion engines with spark ignition. The system of FIG. 1 comprises an ignition coil 10 having a primary winding 12 and a secondary winding 14. The primary winding 12 is connected to the positive pole of a supply battery. The current flowing in the primary winding 12 (hereinafter "primary current") is controlled by a control transistor 16 that is piloted by an electronic control unit 18. The control transistor 16 can be switched between two operating positions in which it, respectively, opens and closes the connection to earth of the primary winding 12. The electronic control unit 18 receives information regarding the phase and speed of rotation of the engine from sensors of a known type and controls the opening and closing of the control transistor 16 to produce a spark on the spark plug connected to the secondary winding 14 at a predetermined lead time with respect to the point at which the piston reaches its top dead centre position.

In the variant illustrated by FIG. 2 the primary winding 12 of the coil 10 is connected to a condenser 20 supplied from a voltage transformer 22 that steps up the battery voltage from 12 V to a value of, say, 400 V. In this case a controlled diode 24 performs the function of the control transistor of the ignition system of FIG. 1. The diode 24 is controlled by the electronic control unit 18 and, whenever it is switched from its open position to its closed position, it causes the energy accumulated by the condenser 20 to be instantaneously discharged onto the primary coil 12, thereby determining a charging cycle of the primary current.

Referring now to FIG. 3, in ignition systems of the traditional type there is normally produced only a single charging cycle C of the primary current I for every engine cycle corresponding to 720° of rotation of the engine shaft. The upper part of the graph of FIG. 3 illustrates the variations of the primary current $I_1$ as a function of time. Each charging cycle C is represented by a triangular wave form of the primary current with a gradual growth from zero to the maximum value $I_{1max}$ and then a brusque return to zero. The duration Tc of each charging cycle C in systems of the traditional type is generally greater than 2 ms and normally varies in the range between 2 and 5 ms. By way of example, in a system of the known type the maximum intensity of the primary current $I_{1max}$ amounts to about 5–8 A. The secondary voltage $V_2$ reaches a peak that corresponds to the sudden change of the primary current and has a maximum value $V_{2max}$ that may vary between 20 and 35 kV. The secondary voltage peak produces a discharge cycle K during which a spark is triggered and maintained by the secondary current $I_2$, which has a triangular wave form that commences from the maximum value of the peak corresponding to the secondary voltage peak and then reduces to zero in a time DA that represents the spark duration. The maximum intensity of the secondary current $I_{2max}$ may be of the order of 60–100 mA, with a duration DA of the discharge cycle K between 1 and 3 ms.

The time patterns of the primary current $I_1$, the secondary voltage $V_2$ and the secondary current $I_2$ in an ignition system according to the present invention are shown in a schematic manner in FIG. 4. The characterizing aspect of the present invention consists of the fact that a succession of charging cycles $C_1$, $C_2$, . . . $C_n$ is applied in the course of a single engine cycle, each of the cycles $C_1$, $C_2$ . . . $C_1$ having a duration Tc of less than 400 $\mu$s and preferably comprised between 50 and 250 $\mu$s. These values are valid, in particular, for four-stroke engines of the automotive type with maximum engine rotation regimes of the order of 5000–6000 r.p.m. The maximum intensity $I_{1max}$ of the primary current may vary between 8 and 20 A according to the particular application. Each charging cycle produces a respective secondary voltage peak having an intensity of the order of 20–35 KV and has a duration that may vary, for example, between 5 and 30 $\mu$s. Each secondary voltage peak, in its turn, produces a discharge cycle $K_1$, $K_2$, . . . $K_n$, each of which has, for example, a duration DA of the order of 60–120 $\mu$s and a current intensity $I_{2max}$ of the order of 80–200 mA.

The charging cycles $C_1$, $C_2$ . . . $C_n$ are separated from each other by a time interval W and have an amplitude equal to or greater than the duration DA of each discharge cycle. Experimental tests carried out by the applicants have shown that the best results from the point of view of combustion quality are obtained with charging cycles that follow each other in the most rapid succession possible, though without any part of a charging cycle being superposed on the previous spark. Consequently, the duration of the interval W between two successive charging cycles within one and the same engine cycle is preferably equal to the sum of the durations of the intervals R and DA.

The overall duration of the group of charging cycles in relation to the duration of the engine cycle and the number of charging cycles during each engine cycle can be determined as a function of the type of engine and the type of ignition strategy it is proposed to apply. In particular, the overall number of charging cycles can be either fixed or may be varied by the electronic control unit as a function of particular engine operating parameters. For example, the control unit could be provided with a memory that will furnish the number of charging cycles to be applied as a function of the speed of rotation of the engine or as a function of the angle of aperture of the throttle valve that determines the quantity of air sucked in during each engine cycle.

One of the most important advantages of the system according to the invention consists of the possibility of using ignition coils having a very small inductance as compared with their traditional counterparts and, consequently, being of very limited mass and size. Use of an ignition system in accordance with the invention makes it possible to standardize the ignition coils, because the ignition system can always be adapted to the particular engine characteristics by acting on the program of the electronic control unit, which can take the form, for example, of varying the intensity and the number of the charging cycles in accordance with needs.

From the operating point of view, implementation of an ignition system according to the invention requires one to modify the frequency of the pilot signals by means of which -She electronic control unit 18 controls the switching movements of the transistor 16 or the controlled diode 24. Alternatively, if one wants to avoid modifying the existing control units, one could arrange a frequency multiplier stage between a control unit of the traditional type and the semiconductor device 16, 24 to adjust the frequency of the pilot signals. This frequency multiplier stage could be housed in a supporting structure carrying a number of ignition coils equal to the number of engine cylinders.

Turning now to FIG. 5, experimental tests carried out by the applicants have shown that the rate of growth of the primary current $I_1$ during each charging cycle depends on whether combustion has effectively occurred within the combustion chamber. More precisely, when combustion does not occur, the primary current grows in a substantially linear manner, following a line having a slope $\alpha_1$ until it attains its maximum value (charging cycle $C_1$). But when the charging cycle takes place while a combustion cycle H occurs within the combustion chamber, the primary current $I_1$ at first grows at a much faster rate than in the absence of combustion: as schematically illustrated in the case of charging cycle $C_2$, the initial growth line of the primary current makes an angle $\alpha_2$ with the horizontal, where $\alpha_2$ is decidedly larger than the angle $\alpha_1$. Subsequently the rate of current growth becomes attenuated, the current eventually attaining its maximum value along a second substantially rectilinear tract of a much smaller inclination than the first. According to a particular aspect of the present invention, this fact can be exploited for producing information to show whether or not combustion has effectively occurred in certain phases of the engine cycle. This information can be obtained by including in the supply circuit of the ignition coil appropriate means capable of recognizing the growth rate of the primary circuit It can also be obtained, for example, by detecting the time the current takes to exceed a certain threshold value that may be equal to, say, half or a third of its maximum value.

The information as to whether combustion has or has not taken place during a certain phase of the engine cycle can be utilized for diagnosis purposes, i.e. detecting lack of ignition, undesired spontaneous ignition, knocking, etc. This information can also be used for varying the number of charging cycles from n to n', where n is the number of cycles set by the control unit as a function of—for example—the engine speed or the angle of aperture of the throttle valve and n' is a number of such cycles that differs from n by either a positive or a negative integer dn.

With a view to obtaining such diagnoses during the entire engine cycle, one may also arrange for charging cycles to be produced during either the entire duration of the engine cycle or a considerable part thereof. When it is proposed to produce a large number of charging cycles during each engine cycle, it may be advantageous to reduce the amplitude of the charging cycles after the system has ascertained that combustion has effectively occurred. Referring to the graph of FIG. 5, as soon as the system detects the rapid growth of the primary current that signals the fact that combustion is taking place, the amplitude of the cycle in quest on and of all subsequent charging cycles during that particular engine cycle can be appropriately reduced. In the example of FIG. 10, the first charging cycle C has not produced the spark and the pattern of the secondary current corresponding to the first charging cycle $C_1$ has therefore been indicated by means of broken lines. The second charging cycle $C_2$ produces a regular spark and triggers combustion in the combustion chamber. During the third charging cycle $C_3$ the system detects a rapid growth of the primary current $I_1$ and the maximum current can therefore be reduced to a much smaller value than the maximum value during a normal charging cycle. The energy of the reduced-amplitude charging cycles is not sufficient to produce a spark, but these cycles can nevertheless be used for diagnosis purposes, because the rate of growth of the primary current will still depend on whether or not combustion is effectively taking place. As shown by the example of FIG. 7, in fact, once the system has detected the fact that combustion is taking place, which may occur during, say, charging cycle $C_2$, all the subsequent charging cycles have no other purpose than monitoring the engine cycle and may therefore have their current intensity reduced. The wave form of the charging cycles becomes modified according to whether combustion is or is not taking place and this property can be used for signalling to an engine control unit the duration DH of the combustion cycle H and the presence in the engine cycle of any irregular combustion phenomena like the one indicated by $H_1$ in the graph of FIG. 7.

We claim:

1. An ignition system for internal combustion engines with spark ignition, the system comprising:

an ignition coil having a primary winding and a secondary winding, a spark plug connected to the secondary winding and capable of producing a spark whenever a voltage at terminals of the spark plug exceeds a predetermined threshold value, an electric supply circuit associated with the primary winding and including a semiconductor device that can be cyclically switched between a first and a second operating position so as to produce a charging cycle in the course of which instantaneous current flowing in the primary winding gradually increases from a minimum value to a maximum value and then returns brusquely to the minimum value in such a manner as to produce a discharge cycle in the course of which instantaneous current flowing in the secondary winding gradually reduces from a maximum value to a minimum value, an electronic control unit capable of controlling the switching movements of the semiconductor device as a function of appropriate engine operating parameters, and combustion control means capable of providing during each engine cycle an electric signal that indicates whether combustion has or has not occurred in the combustion chamber and is obtained as a function of the growth rate of the primary current, wherein the electronic control unit is programmed to produce a succession of charging and discharge cycles during one and the same engine cycle, each of the charging cycles being separated from the previous charging cycle by a time interval equal to or greater than the duration of a discharge cycle.

2. The system of claim 1, wherein the electronic control unit is programmed to produce a constant and predetermined number of charging cycles during each engine cycle.

3. A system of claim 1, wherein the electronic control unit is programmed to produce a number of charging cycles n in each engine cycle, where n is equal to or greater than 2 and is determined as a function of at least one engine operating parameter.

4. The system of claim 3, wherein the number of charging cycles n is determined as a function of the angle of aperture of a throttle valve that determines the quantity of air sucked in during each engine cycle.

5. The system of claim 3, wherein the number of charging cycles n is determined as a function of the speed of rotation of the engine.

6. The system of claim 3, wherein the electronic control unit is programmed to produce during each engine cycle a number of charging cycles n'=n+dn, where dn is an integer determined as a function of at least one other engine operating parameter.

7. The system of claim 6, wherein dn is determined according to whether combustion has or has not occurred in the combustion chamber of the engine.

8. The system of claim 2, wherein the electronic control unit is programmed for varying the maximum intensity of the primary current of one or more of the charging cycles as a function of at least one engine operating parameter.

9. The system of claim 8, wherein the maximum intensity of the primary current is varied according to whether combustion has or has not occurred in the combustion chamber.

10. The system of claim 1, wherein the electric control unit is programmed for receiving the electric signal indicating whether combustion has or has not occurred and producing one or more charging cycles with a reduced value of the maximum primary current after the electric signal indicates that combustion has effectively occurred in that particular engine cycle.

11. The system according to claim 1, wherein the duration of each of the said charging cycles is less than 400 $\mu$s.

12. The system of claim 1, wherein each of the charging cycles has a duration comprised between 50 and 250 $\mu$s.

13. The system of claim 3, wherein the electronic control unit is programmed for varying the maxium intensity of the primary current of one or more of the charging cycles as a function of at least one engine operating parameter.

14. The system of claim 13, wherein the maximum intensity of the primary current is varied according to whether combustion has or has not occurred in the combustion chamber.

15. The system of claim 2, further comprising combustion control means capable of providing during each engine cycle an electric signal that will indicate whether combustion has or has not occurred in the combustion chamber and is obtained as a function of the growth rate of the primary current.

16. The system of claim 15, wherein the electric control unit is programmed for receiving the electric signal indicating whether combustion has or has not occurred and producing one or more charging cycles with a reduced value of the maximum primary current after the electric signal indicates that combustion has effectively occurred in that particular engine cycle.

17. The system of claim 3, further comprising combustion control means capable of providing during each engine cycle an electric signal that will indicate whether combustion has or has not occurred in the combustion chamber and is obtained as a function of the growth rate of the primary current.

18. The system of claim 17, wherein the electric control unit is programmed for receiving the electric signal indicating whether combustion has or has not occurred and producing one or more charging cycles with a reduced value of the maximum primary current after the electric signal indicates that combustion has effectively occurred in that particular engine cycle.

19. An ignition system for internal combustion engines with spark ignition, the system comprising:

an ignition coil having a primary winding and a secondary winding, a spark plug connected to the secondary winding and capable of producing a spark whenever a voltage at terminals of the spark plug exceeds a predetermined threshold value, an electric supply circuit associated with the primary winding and including a semiconductor device that can by cyclically switched between a first and a second operating position so as to produce a charging cycle in the course of which instantaneous current flowing in the primary winding gradually increases from a minimum value to a maximum value and then returns brusquely to the minimum value in such a manner as to produce a discharge cycle in the course of which instantaneous current flowing in the secondary winding gradually reduces from a maximum value to a minimum value, and an electronic control unit capable of controlling the switching movements of the said semiconductor device as a function of appropriate engine operating parameters, wherein:

the electronic control unit is programmed to produce a succession of charging and discharge cycles during one and the same engine cycle and, further, that each of the said charging cycles is separated from the previous charging cycle by a time interval equal to or greater than the duration of a discharge cycle, the electronic control unit is programmed to produce a constant and predetermined number of charging cycles during each engine cycle, and the electronic control unit is programmed for varying the maximum intensity of the primary current of one or more of the charging cycles as a function of at least one engine operating parameter.

20. An ignition system for internal combustion engines with spark ignition, the system comprising:

an ignition coil having a primary winding and a secondary winding, a spark plug connected to the secondary winding and capable of producing a spark whenever a voltage at terminals of the spark plug exceeds a predetermined threshold value, an electric supply circuit associated with the primary winding and including a semiconductor device that can by cyclically switched between a first and a second operating position so as to produce a charging cycle in the course of which instantaneous current flowing in the primary winding gradually increases from a minimum value to a maximum value and then returns brusquely to the minimum value in such a manner as to produce a discharge cycle in the course of which instantaneous current flowing in the secondary winding gradually reduces from a maximum value to a minimum value, and an electronic control unit capable of controlling the switching movements of the said semiconductor device as a function of appropriate engine operating parameters, wherein:

the electronic control unit is programmed to produce a succession of charging and discharge cycles during one and the same engine cycle and, further, that each of the said charging cycles is separated from the previous charging cycle by a time interval equal to or greater than the duration of a discharge cycle, the electronic control unit is programmed to produce a number of charging cycles n in each engine cycle, where n is equal to or greater than 2 and is determined as a function of at least one engine operating parameter, and the electronic control unit is programmed for varying the maximum intensity of the primary current of one or more of the charging cycles as a function of at least one engine operating parameter.

21. An ignition system for internal combustion engines with spark ignition, the system comprising:

an ignition coil having a primary winding and a secondary winding, a spark plug connected to the secondary winding and capable of producing a spark whenever a voltage at terminals of the spark plug exceeds a predetermined threshold value, an electric supply circuit associated with the primary winding and including a semiconductor device that can by cyclically switched between a first and a second operating position so as to produce a charging cycle in the course of which instantaneous current flowing in the primary winding gradually increases from a minimum value to a maximum value and then returns brusquely to the minimum value in such a manner as to produce a discharge cycle in the course of which instantaneous current flowing in the secondary winding gradually reduces from a maximum value to a minimum value, and an electronic control unit capable of controlling the switching movements of the said semiconductor device as a function of appropriate engine operating parameters, and combustion control means capable of providing during each engine cycle an electric signal that will indicate whether combustion has or has not occurred in the combustion chamber and is obtained as a function of the growth rate of the primary current, wherein:

the electronic control unit is programmed to produce a succession of charging and discharge cycles during one and the same engine cycle and, further, that each of the said charging cycles is separated from the previous charging cycle by a time interval equal to or greater than the duration of a discharge cycle, and the electronic control unit is programmed to produce a constant and predetermined number of charging cycles during each engine cycle.

22. An ignition system for internal combustion engines with spark ignition, the system comprising:

an ignition coil having a primary winding and a secondary winding, a spark plug connected to the secondary winding and capable of producing a spark whenever a voltage at terminals of the spark plug exceeds a predetermined threshold value, an electric supply circuit associated with the primary winding and including a semiconductor device that can by cyclically switched between a first and a second operating position so as to produce a charging cycle in the course of which instantaneous current flowing in the primary winding gradually increases from a minimum value to a maximum value and then returns brusquely to the minimum value in such a manner as to produce a discharge cycle in the course of which instantaneous current flowing in the secondary winding gradually reduces from a maximum value to a minimum value, an electronic control unit capable of controlling the switching movements of the said semiconductor device as a function of appropriate engine operating parameters, and combustion control means capable of providing during each engine cycle an electric signal that will indicate whether combustion has or has not occurred in the combustion chamber and is obtained as a function of the growth rate of the primary current, wherein:

the electronic control unit is programmed to produce a succession of charging and discharge cycles during one and the same engine cycle and, further, that each of the said charging cycles is separated from the previous charging cycle by a time interval equal to or greater than the duration of a discharge cycle, and the electronic control unit is programmed to produce a number of charging cycles n in each engine cycle, where n is equal to or greater than 2 and is determined as a function of at least one engine operating parameter.

* * * * *